US005180171A

United States Patent [19]

Panzica et al.

[11] Patent Number: 5,180,171

[45] Date of Patent: Jan. 19, 1993

[54] GAME PROJECTILE

[76] Inventors: Patricia S. Panzica; Guy I. Goodrell, both of 37 Macon Dr., Henrietta, N.Y. 14623

[21] Appl. No.: 909,793

[22] Filed: Jul. 7, 1992

[51] Int. Cl.[5] ..... A63B 65/00

[52] U.S. Cl. ..... 273/428

[58] Field of Search ..... 273/428, 425, 426, 427

[56] References Cited

U.S. PATENT DOCUMENTS

| | | | |
|---|---|---|---|
| 2,187,493 | 1/1940 | Gordon | 273/427 |
| 2,506,815 | 5/1950 | Shaffer | 273/427 X |
| 4,149,723 | 4/1979 | Simon | 273/428 X |
| 4,309,038 | 1/1982 | Spoon | 273/428 |

FOREIGN PATENT DOCUMENTS

| | | | |
|---|---|---|---|
| 14495 | of 1911 | United Kingdom | 273/425 |
| 200817 | 7/1923 | United Kingdom | 273/425 |

*Primary Examiner*—Paul E. Shapiro

*Attorney, Agent, or Firm*—Robert J. Bird

[57] ABSTRACT

A game projectile includes a hub and four gripping arms extending from it at 90° angles in a crossed configuration. The hub and arms include a cover enclosing a body of filler material to form a firm cushion. The arms are about seven inches long and two inches thick for gripping, throwing, and catching. Two of the adjacent arms contrast visually with the other two.

2 Claims, 1 Drawing Sheet

GAME PROJECTILE

FIELD OF THE INVENTION

This invention is a projectile to be thrown, caught, and carried in various ways in a number of different games.

BACKGROUND INFORMATION

There are numerous games involving the use of a ball or other form of projectile, and there are many kinds, sizes, and shapes of balls or projectiles. Balls are hard or soft; bouncy or limp; solid, stuffed, or inflated; spherical or elongated; small, medium, or large. There are disks, javelins, horseshoes, quoits, and boomerangs. They all serve special purposes.

An object of this invention is to provide a new game projectile which lends itself to several new uses.

SUMMARY OF THE INVENTION

The present invention is a game projectile including a hub and four gripping arms extending from it at 90° angles in a crossed configuration. The hub and arms include a cover enclosing a body of filler material to form a firm cushion. The arms are about seven inches long and two inches thick for gripping, throwing, and catching. Two adjacent arms contrast visually with the other two. Catching of the projectile by one color arm versus the other relates to the rules of the games played with it.

DRAWING

DESCRIPTION

Figure 1:
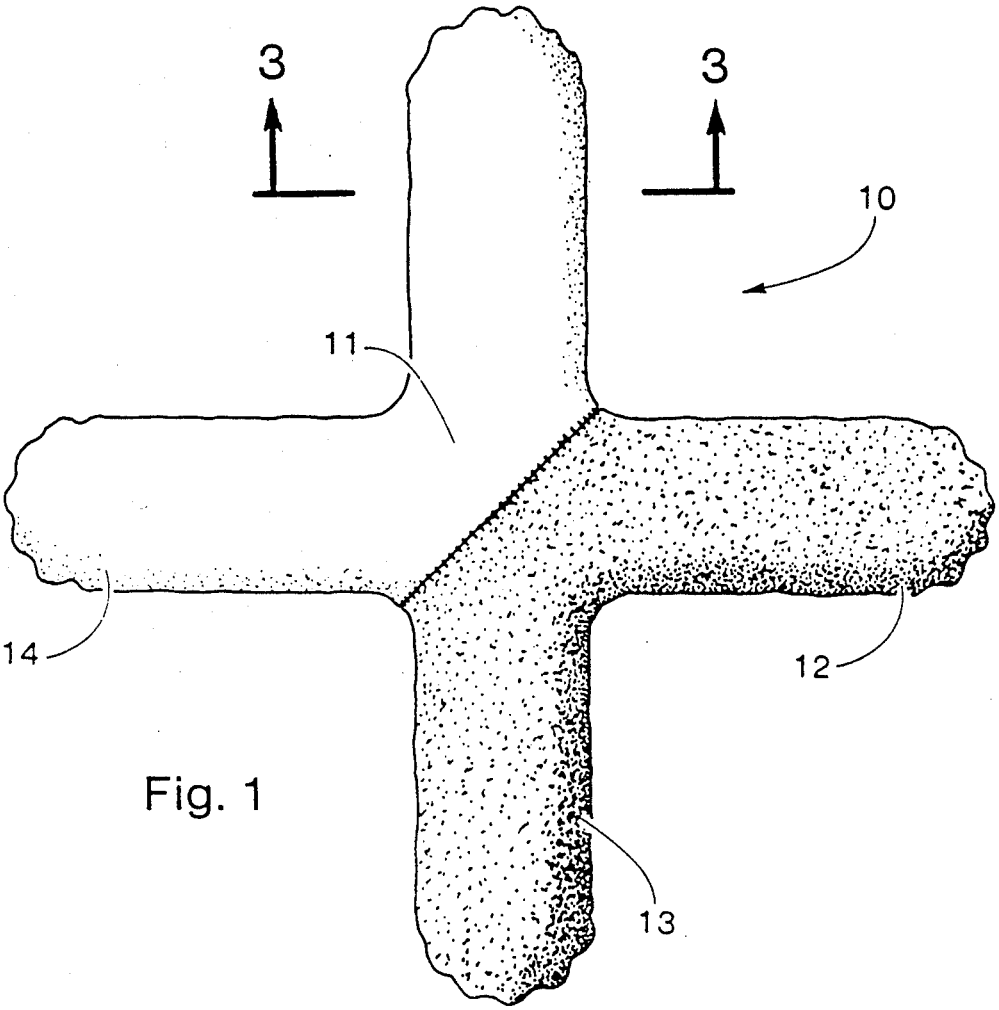
FIG. 1 is a plan view of a game projectile according to this invention.
Figure 2:
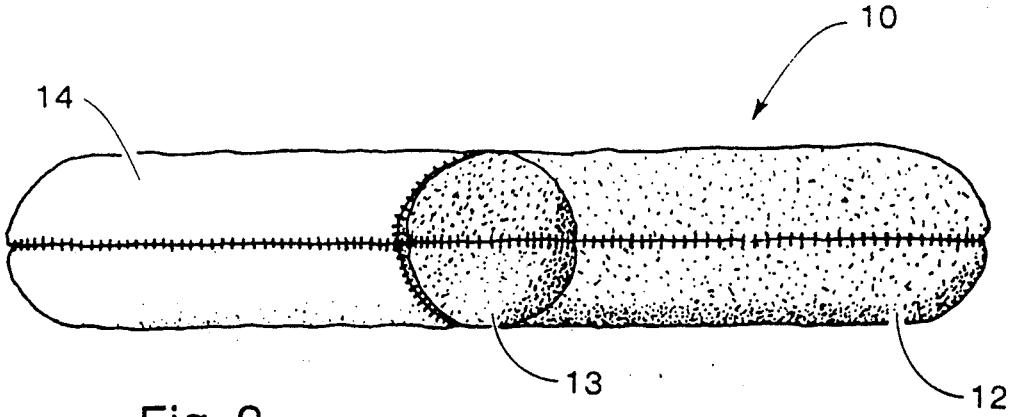
FIG. 2 is a front elevation view of the same.
Figure 3:
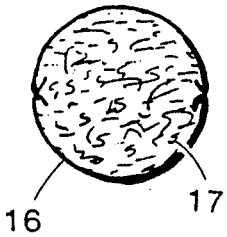
FIG. 3 is a transverse section on the plane 3—3 of FIG. 1.

In the drawing, the projectile 10 includes a central hub portion 11 and four gripping arms 12, 13, 14, 15 extending radially from the hub 11. The arms 12–15 are spaced 90° apart around the hub 11 in a crossed configuration and in a common plane.

The hub 11 and arms 12–15 are formed together of a cover 16 enclosing a body of filler material 17. Fiberfill, a fiber material of 100% polyester is presently preferred as the filler material 17. The cover 16 is packed with filler material 17 so that the consistency or texture of the projectile is that of a firm cushion, resilient but not floppy.

The gripping arms 12–15 are generally cylindrical along their length. They are preferably about seven inches long from the center of the hub 11 and about two inches thick to facilitate gripping, throwing, and catching of the projectile.

Of the four gripping arms, two adjacent arms 12 and 13 are of a dark color or black, and the other two arms 14 and 15 are of a contrasting light color or white. The contrasting colors of the arms relate to the method of use of the projectile in some of the games played with it. For example, scoring, fouls, off side, turnover of possession, and the like are variously determined in some of these games by the skill (or chance) of the receiver in catching the projectile by one color arm versus the other.

The rules and method of play of the games involving our projectile are not directly a part of this invention. The invention is the projectile itself which permits these many games.

The foregoing description of a preferred embodiment of this invention, including any dimensions, angles, or proportions, is intended as illustrative. The concept and scope of the invention are limited only by the following claims and equivalents thereof.

What is claimed is:

1. A game projectile including:

a central hub and four gripping arms extending radially therefrom at 90° angles in a crossed configuration and in a common plane;

said hub and said arms including a cover enclosing a body of filler material, said cover and said filler material together forming a firm cushion;

said arms being generally cylindrical, approximately seven inches in length from the center of said hub and approximately two inches in thickness to facilitate gripping, throwing, and catching thereof.

2. A projectile as defined in claim 1 in which two adjacent arms contrast visually with the other two of said arms.

* * * * *